US006269644B1

(12) United States Patent
Erickson et al.

(10) Patent No.: US 6,269,644 B1
(45) Date of Patent: Aug. 7, 2001

(54) ABSORPTION POWER CYCLE WITH TWO PUMPED ABSORBERS

(76) Inventors: Donald C. Erickson, 1704 S. Harbor La., Annapolis, MD (US) 21401; Gopalakrishnan Anand, 9609 Splendid View, Ellicott City, MD (US) 21042

( * ) Notice: Subject to any disclaimer, the term of this patent is extended or adjusted under 35 U.S.C. 154(b) by 0 days.

(21) Appl. No.: 09/588,512

(22) Filed: Jun. 6, 2000

(51) Int. Cl.[7] ..... F01K 25/06
(52) U.S. Cl. ..... 60/649; 60/668
(58) Field of Search ..... 60/649, 668, 670

(56) References Cited

U.S. PATENT DOCUMENTS 4,122,680 * 10/1978 Isshiki et al. ..... 60/649
4,307,572 * 12/1981 Brinkerhoff ..... 60/649
6,058,695 * 5/2000 Ranasinghe et al. ..... 60/39.182

* cited by examiner

*Primary Examiner*—Hoang Nguyen

(57) ABSTRACT

An absorption power cycle is disclosed which achieves a closer match to heat source temperature glide, and also lower heat source exit temperatures, and hence higher conversion efficiencies, in practical equipment. Referring to FIG. 7, two separate absorbers (725 and 706) are provided, each with a pumping path for a different concentration absorbent liquid to a different temperature location within counter-current high-pressure desorber 721. Heat source 710 heats the high-pressure desorber 721 and superheater 724 in parallel, and subsequently heats intermediate-pressure desorber 761. Dotted lines in the figures signify vapor.

27 Claims, 8 Drawing Sheets

202
201
210
203
206
211
214
213
215
207
219
218
217
212
216
211
205
204

ABSORPTION POWER CYCLE WITH TWO PUMPED ABSORBERS

CROSS-REFERENCE TO RELATED APPLICATIONS

Not applicable.

STATEMENT REGARDING THE FEDERALLY SPONSORED RESEARCH OR DEVELOPMENT

Not applicable.

REFERENCE TO A MICROFICHE APPENDIX

Not applicable.

TECHNICAL FIELD

This invention relates to a method and apparatus for converting thermal energy to mechanical energy utilizing an absorption power cycle. The mechanical energy may further be applied to a variety of useful ends: generating electricity, compressing a vapor, pumping a liquid, or propelling a vehicle or conveyance.

BACKGROUND OF THE INVENTION

Absorption power cycles have been known and practiced for over one hundred years. These cycles are comprised of a circulating absorbent liquid and a condensable working fluid. Vapor phase working fluid is desorbed from the absorbent at high temperature and pressure, then expanded to produce work, and then reabsorbed at low pressure and temperature. Thermal energy is input to the cycle at the high-pressure desorber (also termed generator), and rejected from the low-pressure absorber.

An early example of this cycle was the "soda engine" used to power locomotives and streetcars in Germany in the late 1800s (U.S. Pat. No. 340,718 and 124,594). $H_2O$ was the working fluid, and aqueous NaOH was the usual absorbent. Similar cycles were built in Japan in the 1970s, powering a tricycle, a golf cart, and a pickup truck, and called "concentration difference engines" (U.S. Pat. No. 4,122,680).

An early absorption power cycle using $NH_3$ as working fluid was described by Sellew and Koeneman, and used $ZnCl_2$ as absorbent. More recent absorption power cycles based on the $NH_3$—$H_2O$ pair are disclosed in U.S. Pat. Nos. 3,505,810; 4,307,572; and 5,953,918. An aqua ammonia refrigeration cycle wherein the absorption cycle power is used to pump cycle liquid is disclosed in U.S. Pat. No. 2,408,802.

Another type of power cycle which bears certain similarities to the absorption power cycle is referred to as the "Kalina" cycle (U.S. Pat. Nos. 4,489,563; 4,548,043; 6,058,695; and others). This type of power cycle also uses a multi-component working fluid such as ammonia-water. It differs most prominently from absorption power cycles in that there is no circulating liquid absorbent—the working fluid is entirely evaporated at high pressure in lieu of being desorbed. This necessitates various changes in the lower pressure sections of the cycle as well, e.g., using condensers in lieu of absorbers.

The absorption working pairs used in power cycles can be categorized according to whether the absorbent is volatile or non-volatile. Volatile absorbents will have appreciable presence in the vapor phase as well as the liquid phase, and accordingly the manner in which all mass transfers (latent heat exchanges) are conducted assumes overriding importance. That is, a completely different result is obtained from co-current mass exchange vs. counter-current mass exchange. Ammonia-water is an example of a working pair with volatile absorbent. Note that the Kalina cycles are inherently restricted to volatile absorbents, so as to allow complete evaporation.

Absorption power cycles have the characteristic that the absorbent increases in temperature as more vapor is desorbed from it. Thus it is possible to supply heat of desorption over the corresponding temperature range. For heat sources which are characterized by having a temperature glide (e. g., sensible cooling of a fluid such as combustion exhaust gases or geothermal brine, or condensation of a multi-component vapor), this provides a thermodynamic advantage. More of the source heat can be transferred into the desorbing fluid with reduced loss in availability, and hence more work can be derived from the cycle.

Nevertheless, prior art absorption power cycles have been limited in the degree to which they can match heat source temperature glide, thus limiting their useful work production, by a variety of cycle-specific factors.

First, many cycles produce a low purity ammonia vapor, about 85% purity or lower. In order to avoid excessive moisture formation during expansion, the vapor must be superheated to well above peak desorption temperature. Superheat causes a major variation in the temperature glide, unless several costly stages of reheat are additionally incorporated.

Second, the liquid desorption step itself, although occurring over a wide temperature range, is also relatively non-linear, with much more heating required at the cold end than at the hot end (for reversible desorption).

Third, the temperature glide of desorption is a function of how it is conducted. With co-current desorption all the way to complete vapor (complete evaporation), the glide is limited to the difference between bubble point temperature and dew point temperature. With co-current partial desorption, the glide is even more severely restricted.

Fourth, the low temperature end of the desorption step is usually so warm that there is appreciable useful thermal energy remaining in the source heat even after counter-current heating of the desorbing fluid.

Fifth, the absorption heat rejection is also quite non-linear, requiring higher flowrates of cooling fluid compared to more linear heat rejection scenarios.

Those cycles which entail evaporating the working pair completely to vapor have the problem that trace dissolved solids will become very concentrated and corrosive, and will likely form scale in hot sections of the evaporator. The extreme variation in wetting makes heat transfer very difficult.

It is one object of this invention to overcome the above limitations of the prior art absorption power cycles, so as to achieve a closer match to the temperature glide of the heat source, and hence a more efficient cycle, but in practical and economic equipment.

BRIEF SUMMARY OF THE INVENTION

The above and additional objects are achieved by providing method and apparatus for producing power from thermal energy comprised of an absorption power cycle comprised of: a working pair with a volatile sorbent, such as ammonia-water; a high-pressure generator with temperature glide; a work-expander for vapor from said high-pressure generator; and two spaced-apart liquid feeds to said generator; one pumped from a first absorber; and another at a different concentration pumped from a second absorber. The first absorber is at the low-pressure of the expanded vapor, and is externally cooled. The vapor from the high-pressure generator is at a purity of at least about 90%, and preferably about 95%. The second absorber may be either at low pressure also, in which case it is internally cooled by desorbing liquid; or at intermediate pressure, in which case it is also cooled by external cooling. When using ammonia-water as absorbent, the absorber yielding higher ammonia content absorbent is the one which is pumped to the lower temperature inlet end of the high-pressure generator; and the absorbent from the other absorber, having lower ammonia concentration, is supplied to a mid-section of the high-pressure generator.

Achieving a close match between the temperature glides of the heat source and the cycle heat input, and ultimately a high cycle efficiency, requires a variety of measures or features. The combination of features appropriate will vary with the heat source characteristics: starting temperature, linearity of cool down glide, restrictions on final temperature, heat quantity, type of fluid (liquid, gas, condensable vapor, etc.), and pressure. Some features, such as those disclosed above (two pumped absorbers and vapor purity above 90%) are always desirable; others disclosed below may only apply in certain circumstances.

The 90% purity limitation on the vapor being expanded is related to the allowable wetness (percentage liquid) at the turbine exhaust. Most turbines have a limitation on the order of 7 to 10% maximum liquid at the exhaust, to prevent damage. For peak desorber temperatures less than about 140° C., it is possible to have co-current desorption in conjunction with counter-current heat exchange, followed by vapor-liquid separation, thereby directly yielding vapor of at least 90% purity. Under those circumstances, the vapor inherently has enough temperature to stay within the wetness limitation during work expansion. For higher desorption temperatures, it is necessary to counter-currently desorb the (ammonia) vapor to achieve the desired purity. Then it is further desirable to superheat the vapor over the same temperature range as the counter-current desorption, so as to increase the expansion work.

The counter-current desorption should be fully diabatic when the source heat has temperature glide, as this utilizes source heat to the lowest possible temperature. The desorption may be entirely counter-current diabatic (both mass transfer and heat transfer counter-current), or alternatively only the high temperature segment of desorption may be counter-current diabatic, with the low temperature segment being co-current and diabatic. This reduces the required superheat duty.

In the embodiments wherein the second absorber is at an intermediate pressure and is externally cooled, there are several options possible for the source of intermediate pressure vapor which is being absorbed in that absorber. The selection will depend upon the cycle imposed conditions, as described above. First, when there is no limitation on how cold a heat source with temperature glide may exit, it is usually advantageous to provide an intermediate-pressure generator to supply the intermediate- sure vapor, where the intermediate-pressure generator is heated by the heat source using lower temperature heat than that applied to the high-pressure desorber. This is done by a three-way split of the absorbent out of the low-pressure absorber: one part to the high-pressure generator (mid-section); one part to the intermediate-pressure absorber; and one part to the intermediate-pressure generator.

A second option for supplying the intermediate-pressure vapor is to provide a second work-expander—one which discharges at the intermediate pressure, in addition to the previously recited expander discharging at low pressure.

A third option for supplying the intermediate-pressure vapor is to have "generator-absorber heat exchange," i.e., to have an intermediate-pressure generator (as in option 1) which is heated by internally-generated heat rather than by source heat. The hottest section of the low-pressure absorber, i.e., that section receiving the "strong" absorbent (strong in absorbing power) from the high-pressure generator, supplies heat to the intermediate-pressure generator. For this heat transfer to have maximum effectiveness, the low-pressure absorption should have counter-current mass exchange; and to make it practical, the desorption should be co-current mass exchange and in counter-current heat exchange relationship with the counter-current absorber.

In many scenarios for low-temperature heat utilization, it will be desirable to combine two or more of the above options in the same cycle, e.g., intermediate-pressure generators which are heated by both internal heat and source heat.

The two different feeds to different locations of the high-pressure generator, made possible by the two pumped absorbers, are proportioned so as to make the heat acceptance temperature glide of the high-pressure generator more closely match that of the available source of heat. In some cases, even a third feed at a third concentration and location will also be beneficial. However, the two feeds and corresponding absorbers defined above generally provide the greatest benefit, and are usually all that is necessary.

For the superheated cycles, i.e., those cycles wherein the peak temperature is above about 140° C. and therefore at least the hotter section of the high-pressure generator has counter-current mass transfer and counter-current heat transfer, the fact that the superheating is conducted over the same temperature range as the high-pressure generation is a great advantage. This avoids the marked non-linearity which otherwise occurs in the heat acceptence temperature glide curve of the conventional cycles, which superheat at temperatures above the vaporization temperatures.

It will be recognized that the above disclosure focuses on the critical latent heat exchangers in the absorption power cycle wherein the concentration of the liquid absorbent is changed. As known in the art, there will also normally be present a selection of sensible heat exchangers which heat or cool the absorbent to the approximate temperature of its destination before insertion therein.

In summary, the combination of measures disclosed overcomes the disadvantages of prior art absorption power cycles, and provides a highly efficient cycle in practical equipment.

Figure 3:
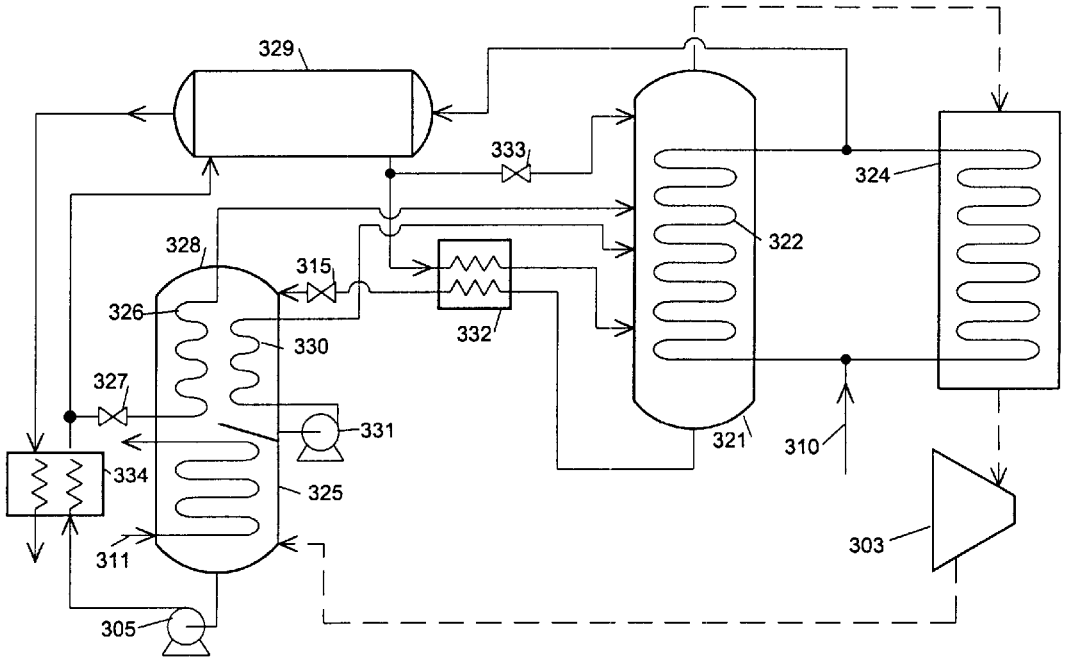

The FIG. 3 cycle has only two pressure levels (high pressure and low pressure), and has a counter-current mass exchange section of the high-pressure generator, with attendant superheating, and both sections of the low-pressure absorber have counter-current mass exchange. Each low-pressure absorber is separately pumped to the high-pressure generator.

Figure 4:
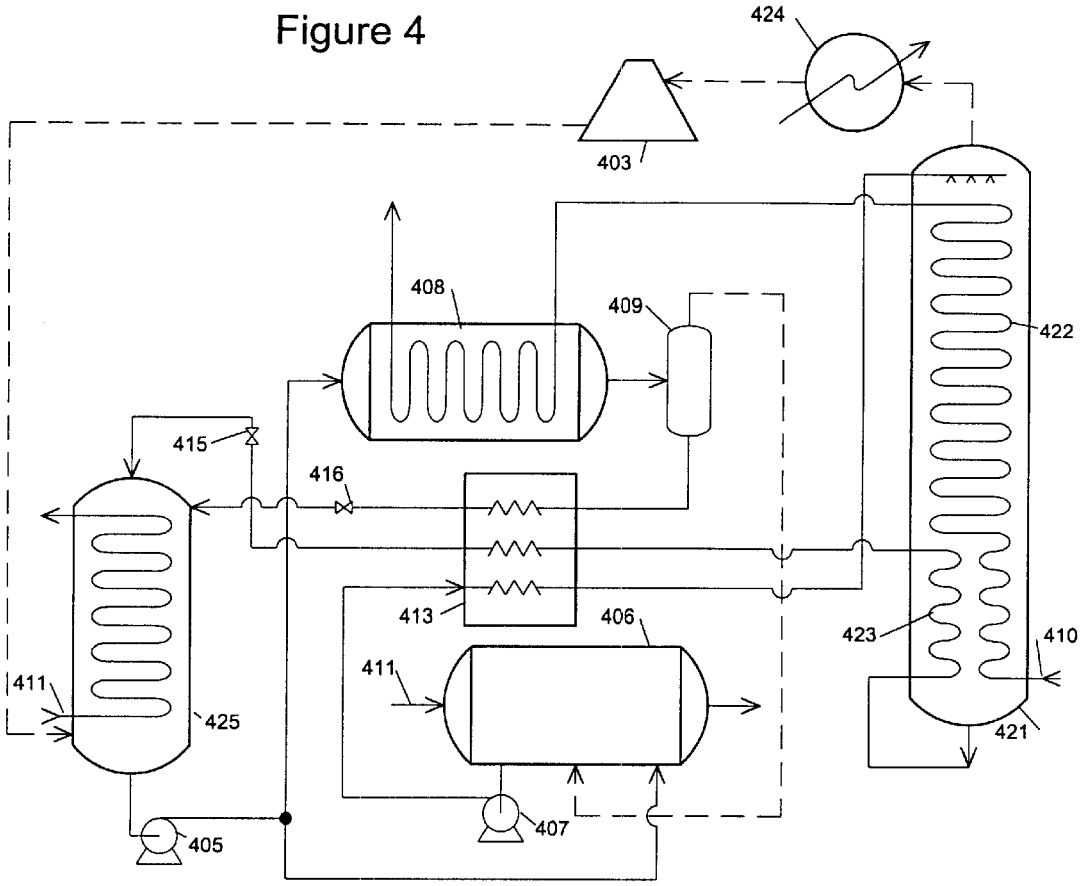

The FIG. 4 cycle is a three-pressure cycle with counter-current high-pressure generation and low-pressure absorption. The intermediate-pressure generator which supplies vapor to the intermediate-pressure absorber is heated by source (external) heat.

Figure 5:
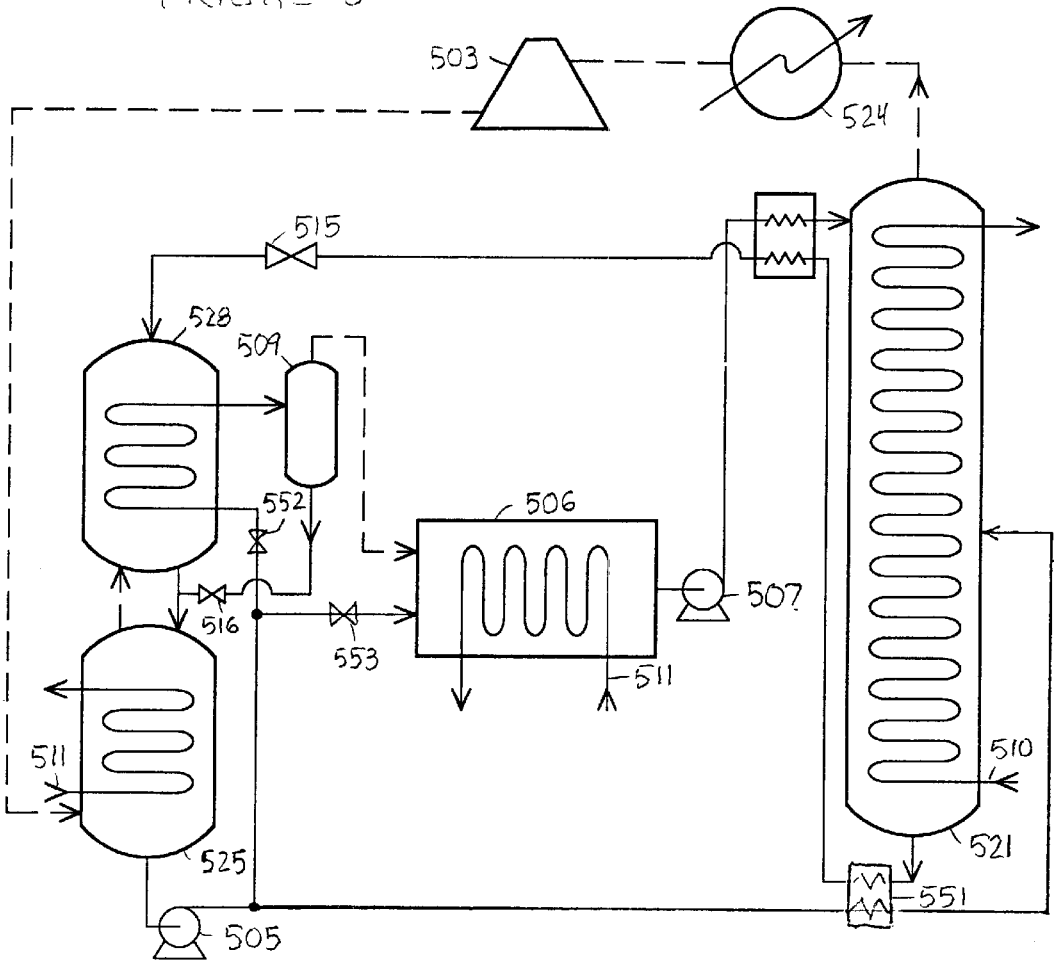

The FIG. 5 cycle is similar to FIG. 4, except the intermediate-pressure generator heat is obtained internally, from the higher temperature portion of the low-pressure absorption process.

Figure 6:
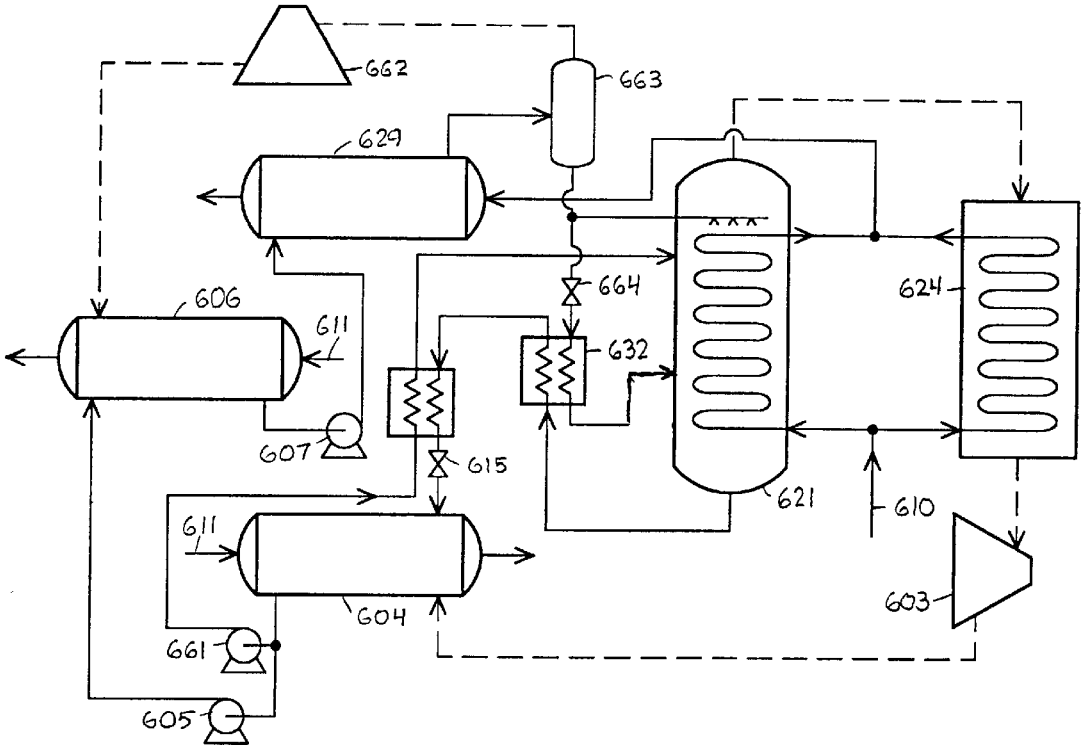

FIG. 6 is a three-pressure cycle with partially counter-current HP desorption wherein the IP vapor for the IP absorber is obtained from a second expander (HP to IP).

Figure 7:
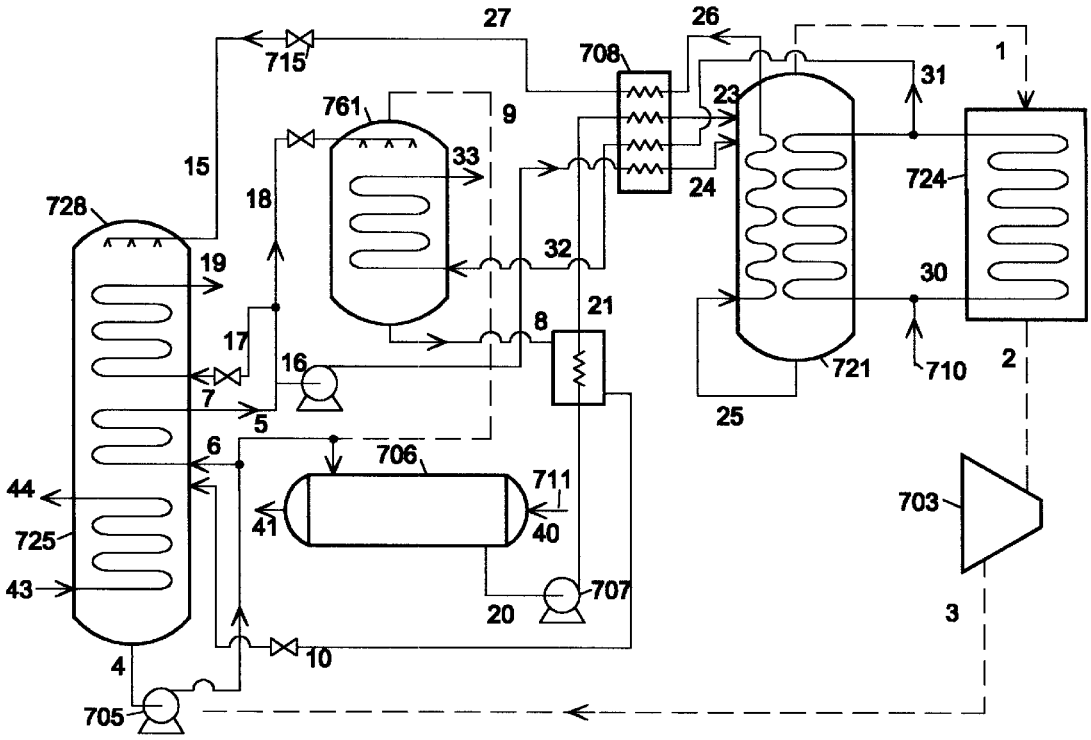

FIG. 7 is a composite of key features of FIGS. 4 and 5. IP vapor is obtained both from internal heat and from external heat.

Figure 8:
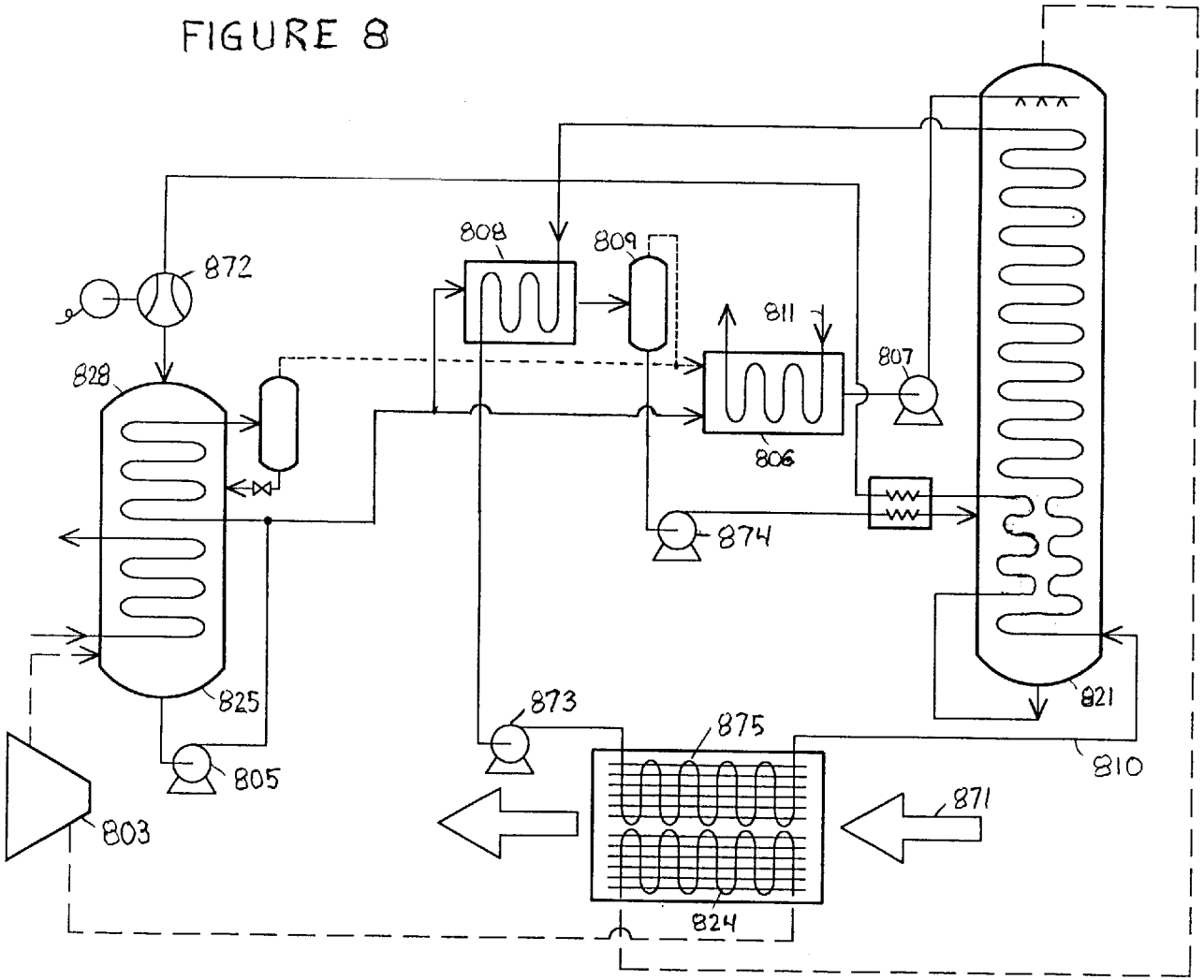

FIG. 8 is another embodiment wherein IP vapor is obtained from two sources of heat.

DETAILED DESCRIPTION OF THE INVENTION

Figure 1:
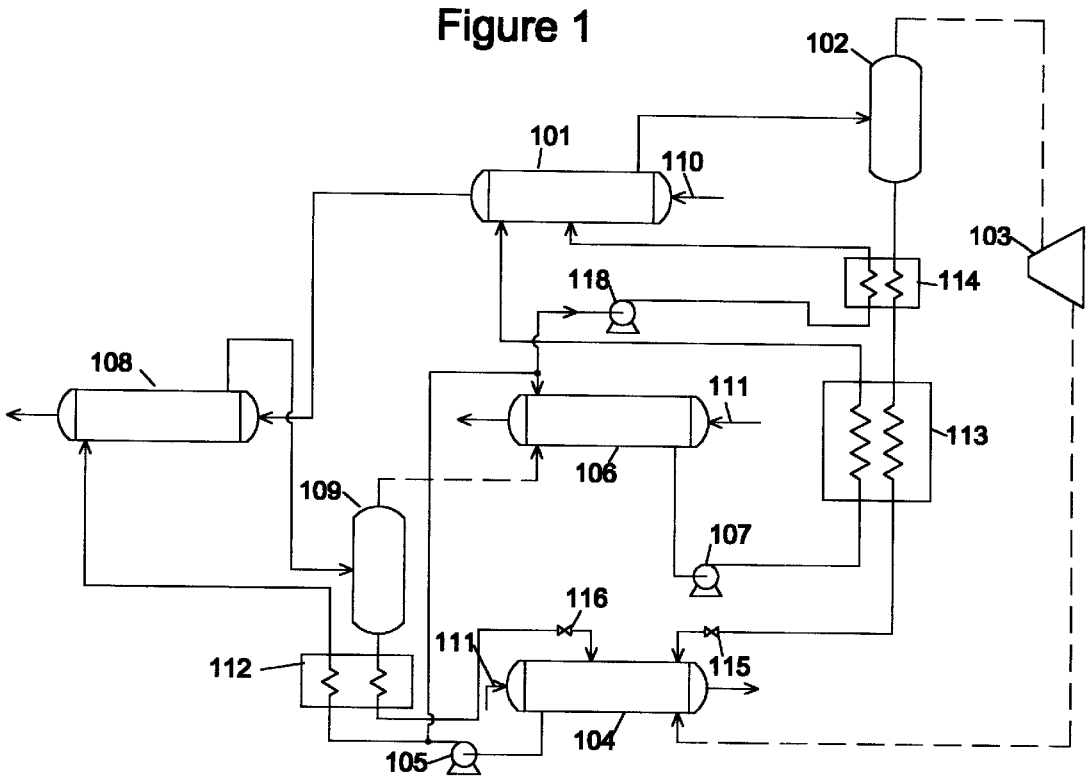
FIG. 1 is an absorption power cycle with all co-current mass transfer, with two absorbers (low and intermediate pressure) each having a pumped pathway to the high-pressure generator, and with an intermediate-pressure generator for supplying vapor to the intermediate-pressure absorber, which is heated by source heat after heating the high-pressure generator.

Referring to FIG. 1, the absorption power cycle is comprised of high-pressure (HP) generator 101, which supplies heated two-phase binary mixture to HP vapor-liquid separator 102. Separated vapor of at least 90% purity (more volatile constituent) is routed to work-expander 103, wherein pressure energy and thermal energy are converted to shaft work, and the vapor exits at low pressure (LP). The LP vapor is absorbed in LP absorber 104, and the resulting weak absorbent (weak in absorbing power) is pumped to intermediate pressure (IP) in pump 105. The weak absorbent is routed to three locations: IP absorber 106; IP desorber 108 (via solution heat exchanger 112); and to a mid-section location of HP generator 101 via pump 118 and sensible heat exchanger 114. Two-phase mixture from IP desorber 108 is separated in IP separator 109; the IP vapor is routed to IP absorber 106 for absorption; and the IP liquid is sensibly cooled and then routed to a mid-section of LP absorber 104. The weakest absorbent (highest ammonia concentration) from IP absorber 106 is pumped to the lowest temperature end of HP generator 101 via pump 107 and sensible heat exchanger 113. Strong absorbent from HP separator 102 is sensibly cooled in exchangers 114 and 113, then let down in pressure by pressure-letdown device 115 (e.g., a valve), and routed to LP absorber 104. Heating fluid 110 is routed sequentially through HP generator 101 and IP generator 108, in direction counter-current to the co-current mass exchange occurring in each generator. Cooling fluid 111 is routed through each externally cooled absorber 104 and 106, in countercurrent direction to the co-current absorption occurring in each absorber.

Figure 2:
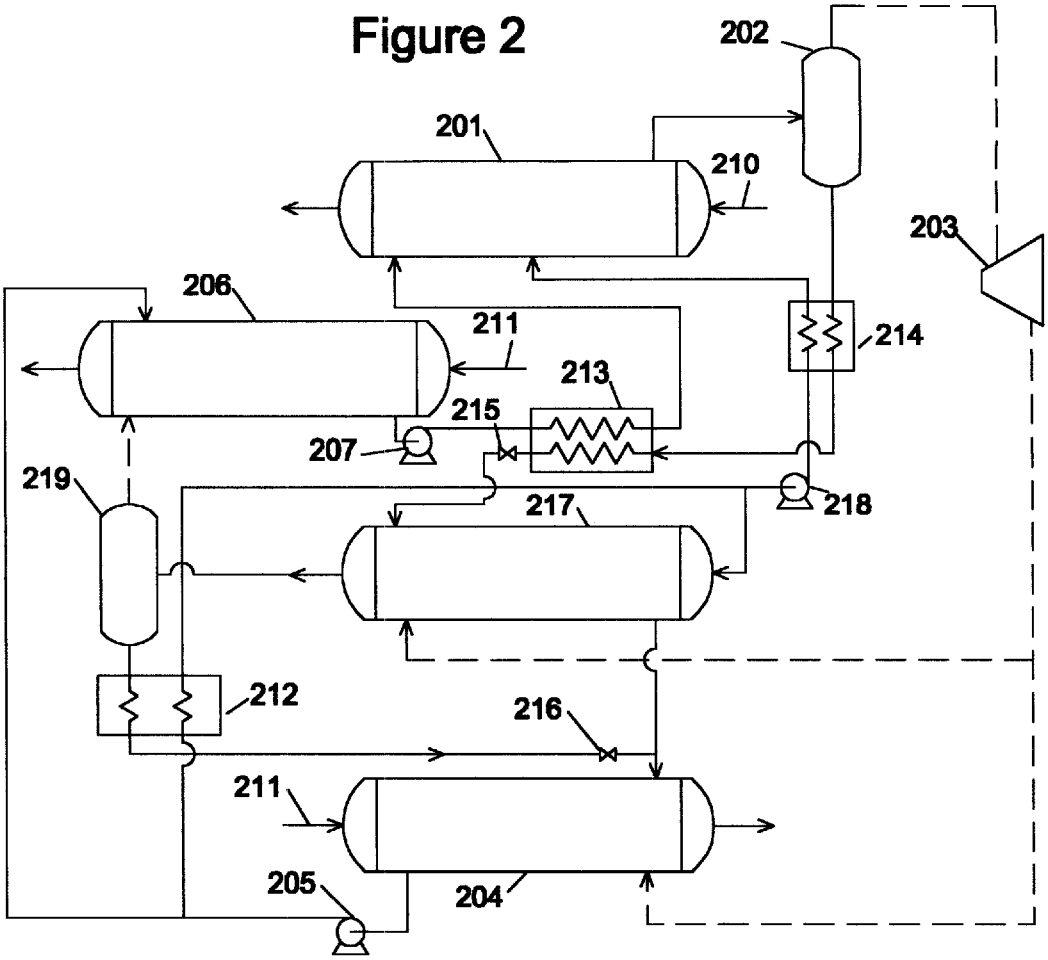
FIG. 2 is similar to FIG. 1, except that the intermediate-pressure generator is heated by internally generated heat, i.e., the hottest segment of the low-pressure absorption heat.

Referring to FIG. 2, components which have the same description as corresponding components of FIG. 1 are given the corresponding 200-series number. That convention applies to all the figures. FIG. 2 differs from FIG. 1 in that the IP vapor for IP absorber 206 is obtained from internal cycle heat, in lieu of external heat. LP absorber/IP generator 217 is supplied part of the vapor from expander 203, and also strong absorbent from pressure letdown 215. The resulting weaker absorbent is routed to low-pressure absorber 204. The heat of absorption released in the shell side of LP absorber/IP generator 217 causes the IP absorbent in the tube side to desorb to a two-phase mixture, which is phase separated in IP separator 219. The separated liquid is routed to LP absorber 204 via pressure letdown 216, and the separated vapor is absorbed in IP absorber 206, thus forming the weakest absorbent for supply to HP generator 201 via pump 218.

FIGS. 1 and 2 both have fully co-current desorptions, implying that their peak cycle temperature is less than about 140° C. so as to yield the 90%+ purity vapor. FIG. 1 would be used when there is no restriction on how low a temperature the heating fluid may exit. FIG. 2 is used when the heating fluid for some reason cannot be reduced in temperature as low as IP generator 108 would cause. Both of these figures are examples of three-pressure cycles.

FIG. 3 is one example of a two-pressure absorption power cycle which can be used with heat sources above 140° C., so as to obtain the benefit of two pumped absorbers and two feeds to the HP generator. Counter-current HP desorber 321 is supplied with heat coils 322 for heating fluid 310, in parallel with similar heating coils in superheater 324. Vapor of at least 90% purity from the cold end (top) of HP desorber 321 is superheated in superheater 324 and expanded to low pressure in work-expander 303. The LP vapor is absorbed in a counter-current mass exchange LP absorber which has a low temperature externally cooled section 325 and a higher temperature internally cooled section 328. Weak absorbent from the LP absorber is pumped by pump 305 to the high pressure, and then is split by split controller 327. One portion is routed to the cold end of high-pressure low-temperature co-current desorber 329; and the other portion is desorbed (latent heat exchanged) in exchanger 326, and then routed to counter-current HP desorber 321. Two-phase fluid from desorber 329 is forwarded to the top section of desorber 321, where it is phase separated; and a liquid fraction from the two-phase fluid is heated by bottom liquid from desorber 321 in latent heat exchanger 332 before entry into the counter-current desorber. The bottom liquid continues to LP absorber 328 via pressure letdown 315. Part of the liquid LP absorbent from between LP absorber sections 328 and 325 is withdrawn and pumped to high pressure in pump 331, sensibly heated in exchanger 330, and then supplied to a mid-section of counter-current desorber 321. Heating fluid 310 heats desorber 329 after heating desorber 321, and finally sensibly heats the absorbent in exchanger 334. The FIG. 4 cycle illustrates countercurrent desorption in a three-pressure cycle, with external heating of IP generator 408. The bottom liquid from counter-current HP generator 421 returns heat internally to the column in exchanger 423, before further cooling in exchanger 413 and pressure letdown 415, into counter-current LP absorber 425, cooled by cooling fluid 411. LP absorber pump 405 sends weak absorbent both to IP absorber 406 and IP generator 408. Weakest absorbent from IP absorber 406 is pumped in pump 407 to the lowest temperature (top) end of counter-current desorber 421.

FIG. 5 is also a three-pressure absorption power cycle, with counter-current HP desorption in desorber 521. It differs from FIG. 4 primarily in the source of heat for generating the IP vapor for IP absorber 506. It uses internal heat for that purpose vice external—heat generated in the higher temperature section 528 of the LP absorber. Also, a single pump 505 is used to supply both HP desorber 521 mid-height feed (via exchanger 551) and also feed to both IP components, via pressure letdowns 552 and 553.

FIG. 6 is also a three-pressure cycle with the higher temperature portion of HP desorption occurring counter-currently in desorber 621. This cycle generates IP vapor for absorption in IP absorber 606 via a second expander 662. The two-phase fluid from low temperature high-pressure desorber 629 is separated in separator 663, and supplied to expander 662. Pump 661 also supplies the HP desorption step, as well as pump 607.

FIG. 7 is a composite of the cycles depicted in FIGS. 4 and 5, in that there are two sources of IP vapor for absorption in IP absorber 706: one from internal heat, and one from external heat. Counter-current IP desorber 761 receives external heat from heat source 710, and IP desorber/LP absorber 728 utilizes the higher temperature segment of the LP absorption heat.

FIG. 7 has statepoints indicated which correspond to the heat and mass balance presented in Table 1.

This heat and mass balance is indicative of the performance that can be expected given a heat source of 168.3° C. water flowing at 4.317 kg/s. The water supplies 950 kW to HP generator 721 and 177 kW to superheater 724 while cooling to 105.9° C., an additional 577 kW to HP generator 708, and 224 kW to IP desorber 761, and exits at 61.5° C. The turbine work is 218.4 kW at 72% isentropic efficiency. The estimated pumping duty of all pumps is 12.3 kWe, leaving net power production of 206.1 kW. This is 10.69% of the input heat.

TABLE 1

| State Point | P (Bar) | X | T (° C.) | H (kJ/kg) | Flow (kg/s) |
|---|---|---|---|---|---|
| 1 | 25.15 | 0.9857 | 94.78 | 1767 | 1 |
| 2 | 25.15 | 0.9857 | 157.2 | 1944 | 1 |
| 3 | 3.91 | 0.9857 | 46.71 | 1726 | 1 |
| 4 | 3.91 | 0.5504 | 23.89 | 49.02 | 3.589 |
| 5 | 8.804 | 0.5504 | 23.89 | 49.02 | 0.06548 |
| 6 | 8.804 | 0.5504 | 23.89 | 49.02 | 3.523 |
| 7 | 8.804 | 0.5504 | 50.38 | 174.7 | 3.523 |
| 8 | 8.804 | 0.4693 | 62.79 | 197.9 | 1.544 |
| 9 | 8.804 | 0.9914 | 60.38 | 1739 | 0.284 |
| 10 | 7.325 | 0.4693 | 56.05 | 165.9 | 1.544 |
| 15 | 3.91 | 0.2535 | 72.78 | 218.7 | 1.044 |
| 16 | 8.804 | 0.5504 | 50.38 | 174.7 | 1.695 |
| 17 | 8.804 | 0.5504 | 50.38 | 174.7 | 0.9681 |
| 18 | 8.804 | 0.5504 | 50.38 | 174.7 | 0.8601 |
| 19 | 8.804 | 0.5504 | 62.79 | 439.2 | 0.9681 |
| 20 | 8.804 | 0.9087 | 23.89 | 352.4 | 0.3495 |
| 21 | 19.71 | 0.9087 | 52.79 | 493.7 | 0.3495 |
| 23 | 25.15 | 0.9087 | 94.78 | 1524 | 0.3495 |
| 24 | 25.15 | 0.5504 | 94.78 | 392.7 | 1.695 |
| 25 | 25.15 | 0.2535 | 157.2 | 615.4 | 1.044 |
| 26 | 8.309 | 0.2535 | 104.8 | 364.7 | 1.044 |
| 27 | 3.494 | 0.2535 | 72.79 | 218.7 | 1.044 |
| 30 | Water | | 168.3 | | 4.317 |
| 31 | Water | | 105.9 | | 4.317 |
| 32 | Water | | 73.9 | | 4.317 |
| 33 | Water | | 61.49 | | 4.317 |
| 40 | Water | | 12.78 | | 53.52 |
| 41 | Water | | 39.27 | | 53.52 |
| 43 | Water | | 12.78 | | 311.7 |
| 44 | Water | | 29.02 | | 311.7 |

FIG. 8 is a three-pressure absorption power cycle with counter-current desorption at HP generator 821, and which includes two sources of IP vapor for IP absorber 806: externally-heated IP desorber 808, and internally heated IP desorber/LP absorber 828. HP desorber 821 has as at least two separate feeds at different concentrations: one from pump 807, and the other from pump 874. Several other features are also illustrated which may apply generally to any of the flowheets: the use of work-expander 872 as a liquid pressure letdown device; and utilizing a combustion gas heat source 871 by providing a closed loop liquid heat transfer system with circulating pump 873 and finned heating coils 875 in parallel with superheater 824.

One preferred geometry for use when countercurrent desorption and/or absorption is called for is the trayed diabatic vapor-liquid contact column. One example of this is found in International Patent Application Number PCT/US98/17339 (WO 00/10696).

What is claimed is:

1. An absorption power cycle with circulating liquid absorbent comprised of a high-pressure generator with temperature glide; a work-expander for vapor from the high-pressure generator; a low-pressure absorber which is externally cooled and which absorbs at least part of the expanded vapor from the work-expander, a first pump which transfers absorbent from the low-pressure absorber to one section of the high-pressure generator, a second absorber; and a second pump which transfers absorbent from the second absorber to a different section of the high-pressure generator.

2. The apparatus according to claim 1 wherein the absorbent is aqua ammonia and the vapor is at least 90% ammonia.

3. The apparatus according to claim 2 wherein said second absorber is supplied low-pressure liquid absorbent from said high-pressure generator; and is cooled by latent heat exchange with one part of the liquid from said first pump.

4. The apparatus according to claim 3 wherein said first pump transfers part of said low-pressure absorber liquid to the lower temperature liquid inlet end of said high-pressure generator; and wherein said second pump transfers part of the liquid from said second absorber to a mid-section of said high-pressure generator.

5. The apparatus according to claim 2 wherein said second absorber is at an intermediate pressure, and additionally comprised of a means for transporting a first part of the absorbent from said low-pressure absorber to said second absorber.

6. The apparatus according to claim 5 wherein said first pump transfers a second part of the absorbent from said low-pressure absorber to a mid-section of said high-pressure generator, and said second pump transfers liquid absorbent from said second absorber to the low-temperature liquid inlet end of the high-pressure generator.

7. The apparatus according to claim 6 additionally comprise of an intermediate-pressure generator which supplies vapor to said intermediate-pressure absorber, and which is supplied a third part of said absorbent from said first absorber.

8. The apparatus according to claim 7 wherein said intermediate-pressure generator is heated by at least one of:

a) source heat after it heats said high-pressure generator; and b) internal heat from a high temperature section of said low-pressure absorber.

9. The apparatus according to claim 6 additionally comprised of a second work-expander which expands part of the high pressure vapor to intermediate-pressure for supply to said intermediate-pressure absorber.

10. The apparatus according to claim 1 wherein said high-pressure generator is comprised of at least two sections, and at least the higher temperature section incorporates counter-current mass exchange and counter-current heat exchange.

11. The apparatus according to claim 3 wherein said second absorber incorporates counter-current mass exchange and counter-current heat exchange.

12. An apparatus for converting thermal energy to mechanical energy in a thermodynamic cycle comprised of:

a) an absorption working pair;

b) a high-pressure component for exchange of heat from said source of thermal energy to said working pair;

c) an expander which produces mechanical work by expansion of vapor from said high-pressure component;

d) a first externally-cooled low-pressure absorber which absorbs vapor from said expander and supplies a first liquid absorbent for pumping to said high-pressure component; and e) at least one of:

i) a second eternally-cooled absorber which is at an intermediate pressure; and ii) a second low-pressure absorber which is cooled by exchange of latent heat with part of the absorbent from said first absorber.

13. The apparatus according to claim 12 wherein said working pair consists of water and ammonia, and said vapor consists of at least 90% ammonia.

14. The apparatus according to claim 13 wherein said second intermediate-pressure absorber supplies a second absorbent at concentration different from said first absorbent for pumping to a lower temperature section of said high-pressure component.

15. The apparatus according to claim 14 wherein said second low-pressure absorber is cooled by intermediate-pressure absorbent which is desorbing so as to supply vapor to said second intermediate-pressure absorber.

16. The apparatus according to claim 13 wherein said second low-pressure absorber is cooled by high-pressure absorbent which is desorbing, so as to add to the vapor supplied to said expander, and additionally comprised of a pumping path from said second low-pressure absorber to said high-pressure component.

17. The apparatus according to claim 13 additionally comprised of an intermediate-pressure generator which is also heated by said source of thermal energy, and which supplies intermediate-pressure vapor for absorption in said intermediate-pressure absorber.

18. The apparatus according to claim 13 additionally comprised of an intermediate-pressure generator which supplies vapor to said intermediate-pressure absorber and which is heated by said second low-pressure absorber.

19. The apparatus according to claim 13 additionally comprised of a second expander which supplies intermediate-pressure vapor to said intermediate-pressure absorber.

20. The apparatus according to claim 13 wherein at least part of said high-pressure component is adapted for counter-current mass exchange; and additionally comprised of a superheater which heats vapor from the low temperature end of said counter-current mass exchanger up to the approximate temperature of the hot end of said counter-current mass exchanger.

21. The apparatus according to claim 17 additionally comprised of means for sensibly heating the liquid absorbents en route to said high-pressure component.

22. A method of converting thermal energy to mechanical energy comprising the cyclical steps of:

a) counter-currently transferring heat to a high-pressure binary working fluid so as to produce a vapor comprised of the more volatile component at a purity of at least 90%;

b) expanding said vapor to low pressure in a mechanical-energy producing expander;

c) absorbing part of said expanded vapor in an externally-cooled low-pressure absorber;

d) absorbing a second part of said low-pressure vapor in an internally-cooled low-pressure absorber which is cooled by latent heat exchange with internal cycle fluid;

e) pumping the binary working liquid from said eternally-cooled absorber to high pressure;

f) supplying part of said high-pressure liquid to said heat transferring step; and g) supplying another part of said high-pressure liquid to said internally-cooled absorber for cooling thereof.

23. The method according to claim 22, additionally comprising superheating the vapor from said heat transferring step over the approximate same temperature range as said heat transferring.

24. The method according to claim 23, additionally comprising supplying vapor to said two absorbing steps in parallel; counter-currently desorbing said working fluid in at least the high temperature portion of said heat transferring step; and circulating a liquid absorbent between said high pressure and said low pressure.

25. A method of converting heat to power comprising:

a) supplying heat to an absorption power cycle comprised of a high-pressure generator, a low-pressure absorber, and an intermediate-pressure absorber;

b) pumping absorbent from said intermediate-pressure absorber to the cold end of said high-pressure generator;

c) pumping part of the sorbent from said low-pressure absorber to a mid-temperature section of said high-pressure generator; and d) work-expanding vapor from said high-pressure generator to low pressure.

26. The method according to claim 25 additionally comprising transferring mass counter-currently in said generator, withdrawing said vapor from the cold end of said generator; and superheating said vapor over the same temperature range as said transferring.

27. The method according to claim 25 additionally comprising supplying vapor to said absorber by at least one of:

a) heating an intermediate-pressure desorber with external heat;

b) heating an intermediate-pressure desorber with internal heat from the high temperature section of the low-pressure absorption; and c) expanding part of the high-pressure vapor to intermediate pressure.

* * * * *